United States Patent [19]

Mitchell et al.

[11] Patent Number: 4,906,007

[45] Date of Patent: Mar. 6, 1990

[54] HAND-THROWABLE FLYING TOY

[76] Inventors: Robert P. Mitchell; Gary P. Petersen, both of 3625 NW. Roosevelt Dr., Corvallis, Oreg. 97330

[21] Appl. No.: 279,818

[22] Filed: Dec. 5, 1988

[51] Int. Cl.[4] ..... A63B 65/10

[52] U.S. Cl. ..... 273/425

[58] Field of Search ..... 273/424, 425; 446/46–48

[56] References Cited

U.S. PATENT DOCUMENTS

| | | | |
|---|---|---|---|
| 2,822,176 | 2/1958 | Robes | 273/424 |
| 3,580,580 | 5/1971 | Wark et al. | 446/48 |
| 3,765,122 | 10/1973 | English | 446/48 |
| 3,828,466 | 8/1974 | Geiger | 446/48 |
| 3,948,523 | 4/1976 | Michael | 273/424 |
| 4,045,029 | 8/1977 | Katzmark | 273/425 |
| 4,151,997 | 5/1979 | Glovak et al. | 273/424 |
| 4,173,839 | 11/1979 | Kovac | 446/46 |
| 4,174,834 | 11/1979 | De Martino | 446/48 |
| 4,176,843 | 12/1979 | DeWitt, Jr. | 446/46 |
| 4,196,540 | 4/1980 | Hembree et al. | 273/424 X |
| 4,216,611 | 8/1980 | Psyras | 273/424 X |
| 4,288,942 | 9/1981 | Nicholl | 446/48 |
| 4,351,129 | 9/1982 | Kerkenbush et al. | 446/46 |
| 4,516,947 | 5/1985 | Pircher et al. | 446/46 |
| 4,568,297 | 2/1986 | Dunipace | 446/46 |
| 4,737,128 | 4/1988 | Modrmann | 273/424 X |

FOREIGN PATENT DOCUMENTS

| | | | |
|---|---|---|---|
| 1196552 | 7/1965 | Fed. Rep. of Germany | 273/424 |

*Primary Examiner*—Paul E. Shapiro

[57] ABSTRACT

A hand-throwable flying toy comprising a convex/concave surface with central aperture and peripheral flange-like rim that can be sailed through the air for use in short-range games of catch and short-range target games is disclosed. When thrown over short distances in a manner to produce both translational and rotational motion, the disclosed toy hovers at the apex of its flight path and then drops vertically downward without tendancy to bank left or right. In the preferred embodiment, means are provided to help stabilize the motion of the toy during descent: edge spoilers facilitate low-drag air flow past the outer edge of the toy; aperture spoilers facilitate low-drag air flow through a centrally-located circular aperture bounded by a circumscribed lip; lower spoilers placed in an annular region on the lower surface of the toy surround the aperture and facilitate the production of a surface-bound doughnut of turbulence that provides the toy with resistance against banking motion.

18 Claims, 6 Drawing Sheets

HAND-THROWABLE FLYING TOY

FIELD OF INVENTION

This invention relates generally to aerodynamically designed discoidal toys and rings and more particularly to a novel flying toy that exhibits straightline flight, hovering, and pinpoint landing characteristics over a flight range of approximately 15 meters.

BACKGROUND OF THE INVENTION

During the last three decades, flying discs and rings have found a variety of recreational uses. Probably the two most popular toys of these types are the flying disc described in U.S. Pat. No. 3,359,678 and sold under the registered trademark Frisbee®, and the flying ring described in U.S. Pat. No. 4,560,358 and sold under the registered trademark Aerobie®. Some other devices of these types described in prior art are listed below:

U.S. Pat. No. 3,312,472—Kerr
U.S. Pat. No. 3,765,122—English
U.S. Pat. No. 3,828,466—Geiger
U.S. Pat. No. 4,045,029—Katzmark
U.S. Pat. No. 4,104,822—Rodgers
U.S. Pat. No. 4,173,839—Kovac
U.S. Pat. No. 4,174,834—De Martino
U.S. Pat. No. 4,176,843—DeWitt, Jr.
U.S. Pat. No. 4,288,942—Nicholl
U.S. Pat. No. 4,370,824—Resnicow
U.S. Pat. No. 4,516,947—Pircher et al.
U.S. Pat. No. 4,669,996—Bershak The basic design of the Frisbee® and similar flying discs, herein referred to as Frisbee-like discs, is that of a convex/concave surface of between 20 and 30 centimeters in diameter and of approximate uniform thickness, circumscribed by a thicker rim that connects smoothly onto the periphery of the surface and extends 1.3 to 3.2 centimeters below the surface. The rim gives the edge of the disc the shape of an airfoil, and serves at least two additional purposes: during throwing, the rim serves as a gripping surface; and, during flight, the inner side of the rim together with the concave lower surface of the disc define a region of restrained air that plays an important role during the well-known hovering or stalling phenomenon that a Frisbee-like disc can be made to exhibit at the apex of its flight path. As used herein, the term hovering refers to a stalling phenomenon that occurs when a Frisbee-like disc is thrown in such a manner that the disc reaches the apex of its flight path with minimal translational energy, the energy of the disc at that point being almost entirely rotational kinetic energy and gravitational potential energy. At the point of hovering, a Frisbee-like disc seems to momentarily rest in midair before beginning to descend. When thrown over distances of 15 meters or less and at an attitude so as to produce the hovering effect, a Frisbee-like disc will invariably descend from its hovering point in a characteristic left or right banking motion.

It should be pointed out that during hovering the translational motion of a Frisbee-like disc actually ceases only instantaneously as the disc stops climbing and begins to descend. During the first second of descent, the disc drops very gradually in much the way a parachute descends, supported by restrained air (often referred to as an "air cushion") beneath its surface. However, unlike a parachute, the hovering motion of a Frisbee-like disc is unstable; the slightest air disturbance can cause the disc to slide off its trapped air cushion, resulting in the banking phenomenon.

Because air conditions immediately near the hovering point of a thrown disc are casually related to the direction a disc will descend, it is not possible for a thrower or a catcher to predict in which direction a hovering disc will bank. In games of catch between skillful and energetic players this unpredictability is part of the fun. However, this same unpredictability makes a Frisbee-like disc unsuitable for use in short-range games of catch or in target games where pinpoint landing accuracy is of primary importance.

Attempts to improve the performance of Frisbee-like discs have concentrated on reducing aerodynamic drag and on increasing aerodynamic lift in order to effect longer and straighter flights. Few, if any, attempts have been made to specifically design a disc with predictable short-range flight characteristics without regard to long-range characteristics. One possible exception is disclosed in U.S. Pat. No. 4,516,947, wherein inventors Pircher et al. disclose a "discoidal amusement device" that contains a central convex cup that these inventors claim enhances "the ability of the disc to gradually descend in a controlled fashion." The wide profile of the device disclosed by Pircher et al. suggests that their disc is useful mainly in short-to-medium range games.

The basic design of the Aerobie® and other flying rings is that of an annulus in which the ratio of the inner radius to the outer radius is 0.75 or greater. Flying rings tend to have a thin profile when viewed in cross section, being aerodynamically shaped to maximize lift and to minimize drag. Unlike a Frisbee-like disc, a flying ring is capable of straight-line flight throughout its flight path, from launching to landing, for flight distances of a few meters to many tens of meters. However, unlike a Frisbee-like disc, a flying ring has neither a flange-like outer rim nor a substantial surface area and is not able to hover in the characteristic Frisbee-like manner.

The present disclosure contemplates a new type of flying toy, one that has as its primary goal the ability to fly straight, hover, and descend vertically but gradually onto a target located directly below its hovering point for all flight distances between a few meters and approximately 15 meters. The object of the disclosure is not to improve prior art by reducing aerodynamic drag or increasing aerodynamic lift on Frisbee-like discs or on flying rings; the object is to provide an easily manufactured novel toy characterized by a predictable, gradual, stable, vertical dropping motion as the toy descends from the apex of its flight path.

SUMMARY OF THE INVENTION

The present invention exhibits straight-line flight, hovering, and vertical descent properties over short-range flight paths. The disclosed toy is light in weight, is of simple and appealing design, and is readily manufactured as a single piece using conventional molding techniques such as injection molding and from plastic materials such as polyethylene and others presently in use with currently popular flying discs and rings.

The disclosed toy has both ring-like and disc-like properties. The toy consists of a substantially planar circular annular section with central aperture, a peripheral flange-like rim, and a surface of curvature that joins the annular section to the rim at a curving point of juncture. When measured from the bottom edge of the rim, the part of the upper surface of the annular section most proximate the aperture is the highest part of the toy. Near the aperture, this upper surface is substantially flat and normal to the principal rotation axis of the toy. Said another way, the upper surface tends to flatten out as the distance from the aperture decreases, the surface having zero horizontal slope when the slope is measured next to the central aperture.

The preferred embodiment of the invention is further characterized by three systems of air spoilers which enhance the stability of the toy during descent. Edge spoilers are located along the outer edge of the rim to facilitate low-drag air flow past the outer edge of the toy. Aperture spoilers, designed to facilitate low-drag air flow through the aperture, are located along the inner surface of a lip that circumscribes the aperture. Lower spoilers, designed to facilitate the production of a surface-bound doughnut of turbulence that encircles the aperture on the lower side of the toy during descent, are located in an annular region on the lower surface of the toy.

Over flight distances of a few meters up to approximately 15 meters, the disclosed toy has the straight-line flight property of a flying ring, yet retains the hovering property of a Frisbee-like disc without exhibiting the banking phenomenon during decent. The objects and advantages of the disclosed design will become more clear in the ensuing paragraphs.

OPERATION OF THE INVENTION

The disclosed toy is designed to be used in catch or target games where the horizontal flight range of the toy is between 5 and 15 meters and when wind speed is minimal. When thrown at an angle of 20 to 60 degrees above horizontal, the disclosed toy will sail in a slightly downward-curving arc to the apex of its flight path and will then stall momentarily before dropping almost vertically onto a target or into the hands of a second player waiting below. The skill of the thrower is used to throw the toy in a left-to-right level but front-to-back "nose up" attitude and impart to the toy just the right amount of translational energy so that the toy reaches it hovering point almost directly above the intended target. The action of the central aperture and the three systems of spoilers ensures that the toy will drop vertically and not bank left or right during descent.

It is interesting to note that when a Frisbee-like disc is thrown hard, comparatively large amounts of both translational and rotational energy are imparted to it, and the disc does have sufficient gyroscopic stability to enable it to drop almost vertically from its hovering point if wind speed is minimal. On the other hand, when a Frisbee-like disc is thrown 15 meters or less, it invariably banks left or right during descent. In the latter case, the disc does not have sufficient rotational energy to ensure gyroscopic stability during descent. The minimal amount of rotational energy imparted to a Frisbee-like disc when the disc is thrown so that its translational energy will carry it no further than 15 meters is insufficient to provide the disc with sufficient gyroscopic stability to overcome the disturbing forces of even relatively quiet air.

By similar argument, the disclosed toy also lacks sufficient rotational energy to give it gyroscopic stability during descent when said toy is thrown over the preferred flight range. It derives its stability during descent from aerodynamic features of its novel design. This stability can be understood by the following explanation which, while we believe it to be substantially accurate, we do not wish to be bound by.

While falling from its hovering point, the disclosed toy is characterized by a column of air flowing through its aperture. Surrounding this column of air is a region of unseparated turbulence that forms near the concave lower side of the toy and surrounds the aperture, the turbulent region being essentially doughnut shaped. This doughnut of turbulence channels the air which is directly below the annular section into a radially outward path where it joins the air stream passing the outer edge of the toy. The toy is held level and prevented from banking by these two air streams: one flowing through its aperture and one flowing past its outer edge. Considered from the reference frame of the dropping toy, the cylindrically-symmetric doughnut of turbulence pinned to the toy's lower surface resists any lateral movement of the toy against the column of air flowing through the aperture and, in effect, provides the toy with resistance against banking motion.

The three systems of spoilers help establish and maintain these stabilizing air flow patterns. Edge spoilers along the outside of the rim help produce low-drag air flow past the rim by "spoiling" the otherwise laminar air flow past the rim. This "spoiling" is a well-known aerodynamic effect that results in decreasing drag or viscosity forces felt by air flowing past a surface. Air flow spoilers, such as the edge spoilers mentioned herein, accomplish the spoiling effect by producing a surface-bound layer of turbulence on the surface over which air is flowing. The low-drag effect is achieved because air is known to move over a bound turbulent layer with greater ease than it moves over a surface on which no turbulent layer is present.

In a similar way, aperture spoilers help produce low-drag air flow over the inner surface of the lip and thereby facilitate air flow through the aperture.

Lower spoilers aid in the establishment of the unseparated doughnut of turbulence that surrounds the aperture on the lower side of the toy's surface.

FURTHER OBJECTS AND ADVANTAGES

Further objects and advantages of the disclosed toy are as follows: the disclosed toy can employ any of a number of air flow spoiler designs to enhance its flight characteristics; the disclosed toy is comparatively easy to grasp and throw; the disclosed toy can be used in short-range games of catch and in target games in which pinpoint landing accuracy is of primary importance; the disclosed toy can be used in short-range games of catch and in target games where space is limited such as in a school gymnasium, in a limited school playing area, or on the playing deck of a cruise ship; the disclosed toy contains a central aperture that can be used as a sighting hole for determining the toy's landing position on a surface target; the disclosed toy contains a central aperture that can be used in target games, one object of which is to "ring" the target by landing the toy so that the target object protrudes through the aperture of the toy; and the disclosed toy can be manufactured out of an elastomer or other soft, resilient material that will enable the toy to be useful and safe when played with indoors.

LIST OF REFERENCE NUMERALS

10 annular section

12 annular rim

Figure 1:
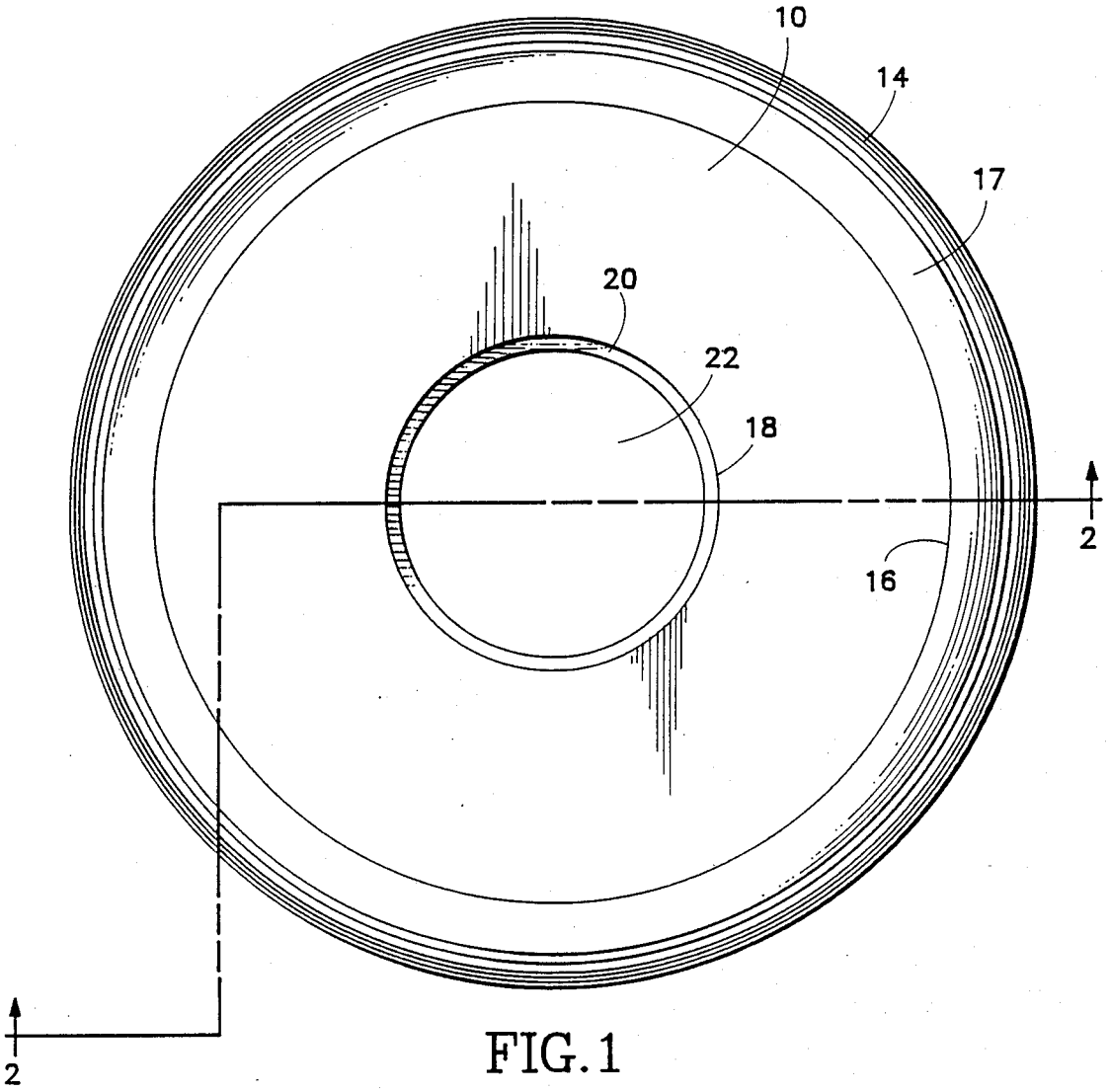
FIG. 1 is a top view of the flying toy incorporating the preferred embodiment of the invention.

14 edge spoilers, preferred embodiment: a plurality of evenly-spaced circular coaxial ridges along curved outer edge of rim

15 principal rotation axis

16 outer boundary of annular section

17 surface of curvature extending from outer boundary of annular section and curving downwardly to a point of juncture with the top edge of rim

18 inner boundary of annular section

20 lip circumscribing central aperture

22 central aperture

24 aperture spoilers, preferred embodiment: a plurality of evenly-spaced circular coaxial ridges along the inner surface of the lip

26 lower spoilers, preferred embodiment: a plurality of evenly-spaced circular coaxial ridges centered on the lower surface of the annular section

28 outer boundary of lower spoilers

30 edge spoilers, alternative embodiment: a plurality of ridges, the edges of which are evenly-spaced line segments along the curved outer edge of the rim, each edge being coplanar with the principal rotation axis

32 aperture spoilers, alternative embodiment: a plurality of ridges, the edges of which are evenly-spaced line segments along the inner surface of the lip, each edge being parallel to the principal rotation axis

34 lower spoilers, alternative embodiment: a system of ridges, the edges of which are radially-directed line segments along the lower surface of the annular section

36 aperture spoilers, alternative embodiment: a plurality of peaked ridges arranged to produce a zigzag pattern around the inner surface of the lip

38 an aperture-circumscribing lip in the form of a bead of circular cross section

DETAILED DESCRIPTION OF THE INVENTION

Figure 2:
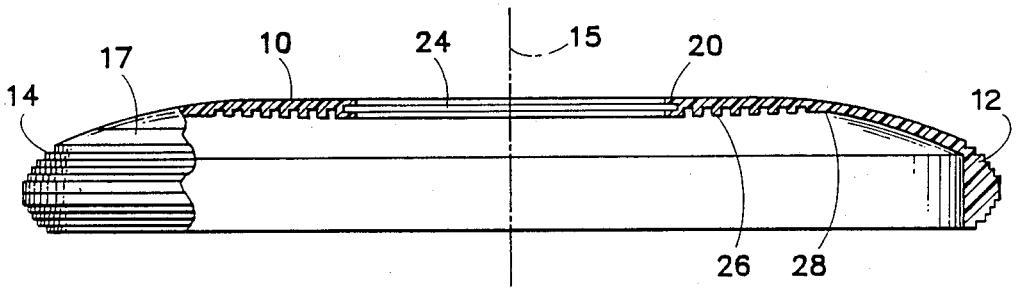
FIG. 2 is a partial section view taken along lines 2—2 of FIG. 1.
Figure 3:
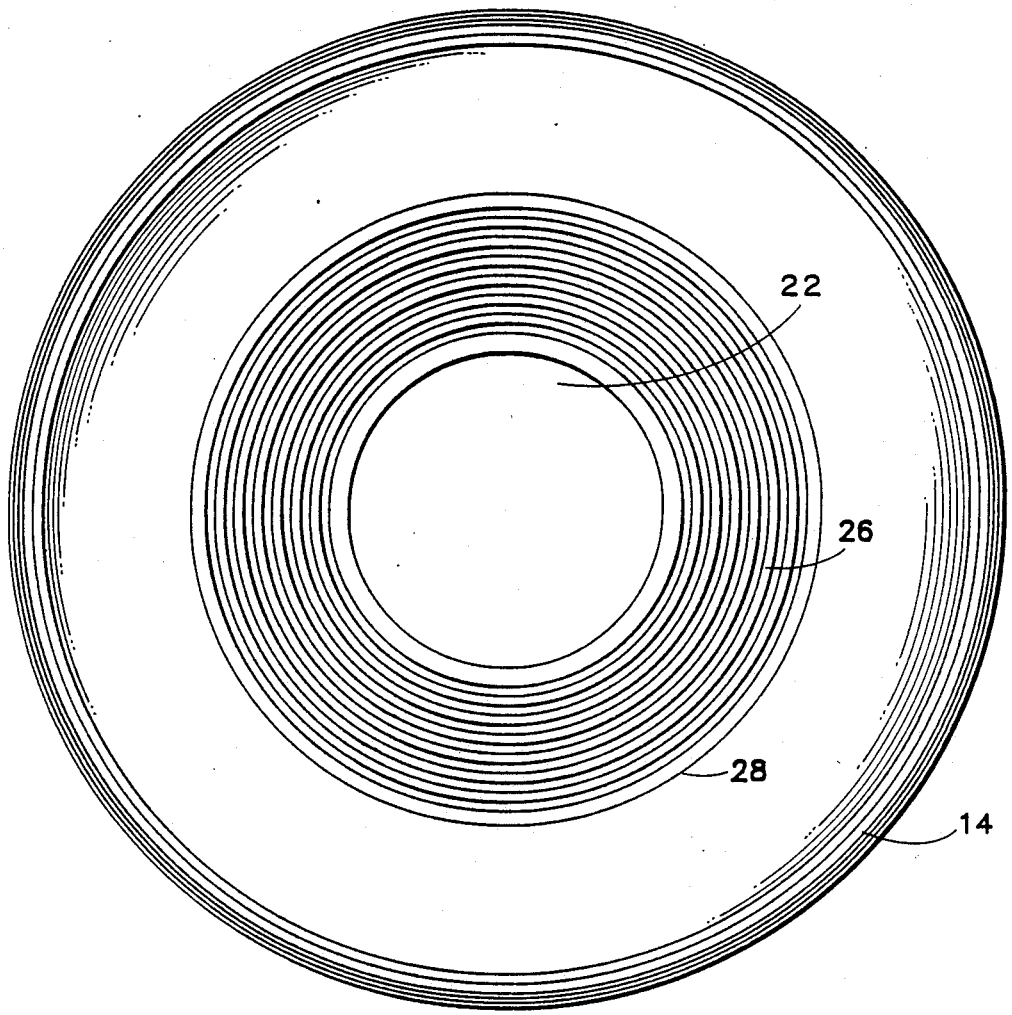
FIG. 3 is a bottom view of the flying toy incorporating the preferred embodiment of the invention.

The preferred embodiment of the present disclosure is shown in FIGS. 1 through 3. The top surface of the toy is comprised in part of a substantially planar circular annular section 10 whose outer and inner boundaries are determined by predetermined radii 16 and 18. As shown in FIG. 2, a thickened annular rim 12 is joined to the annular section 10 by a surface of curvature 17 that extends from the outer boundary 16 of the annular section 10 and curves downwardly to a point of juncture with the top edge of the rim 12. The rim 12, so joined, is continuous with and circumscribes the surface of curvature 17 and the annular section 10, the bottom edge of the rim 12 extending substantially below the apex of the top surface of the annular section 10. A slip 20 is constructed along the inner side of the inner boundary 16, whereby the lip 20 defines the periphery of a single central aperture 22. As shown in FIG. 2, the top edge of the lip 20 is flush with the upper surface of the annular section 10, and the distance from the top edge of the lip 20 to the bottom edge of the lip 20 is approximately 0.5 centimeters. The principal rotation axis of the toy, the axis about which the toy has the largest moment of inertia and the axis about which the toy rotates when it is thrown in the preferred way, is shown as line 15. FIG. 2 also shows that the upper surface of the toy proximate the aperture 22 is substantially flat and is the highest level, or apex, of the toy. Said another way, parts of the upper surface most proximate the aperture 22 are most substantially normal to the principal rotation axis 15.

Edge spoilers 14 comprised of a plurality of evenly-spaced coaxial ridges are superimposed or raised on the outer surface of the rim. Each edge spoiler circles the entire rim, and defines a plane that is substantially normal to the principal rotation axis 15 of the toy. We believe these edge spoilers 14 help stabilize the descent of the disclosed toy by helping to produce low-drag air flow past the outer edge of the toy.

As shown in FIG. 2, aperture spoilers 24 comprised of a plurality of coaxial ridges are superimposed or raised on the inner surface of the lip 20 that circumscribes the central aperture 22. The edges of these ridges 24 are evenly spaced and circular, and are centered on the principal rotation axis 15 of the toy. We believe these aperture spoilers 24 help produce a low-drag air flow through the aperture 22.

As seen in FIGS. 2 and 3, lower spoilers 26 comprised of a plurality of coaxial ridges are superimposed or raised in an annular region on the lower surface of the annular section 10. The edges of these ridges are evenly spaced and circular, and are centered on the principal rotation axis 15 of the toy. The lower spoilers 26 are bounded on the inner side by the bottom edge of the lip 20, and, as seen in FIG. 3, are bounded on the outer side by a circle 28, the radius of which is approximately one-third the radius of the outer edge of the toy. When viewed in cross section, as seen in FIG. 2, the lower spoilers 26 taper from their thickest point at the juncture with the circumscribing lip 20 to their thinnest point at the boundary 28 where they smoothly join the bottom of the annular section 10. We believe these lower spoilers 26 help produce and maintain a stabilizing surface-bound doughnut of turbulence on the lower side of the toy.

Formed as a single piece, the disclosed toy can be described as having an overall convex upper surface, an overall concave lower surface, a central aperture, and three systems of air spoilers.

Figure 4:
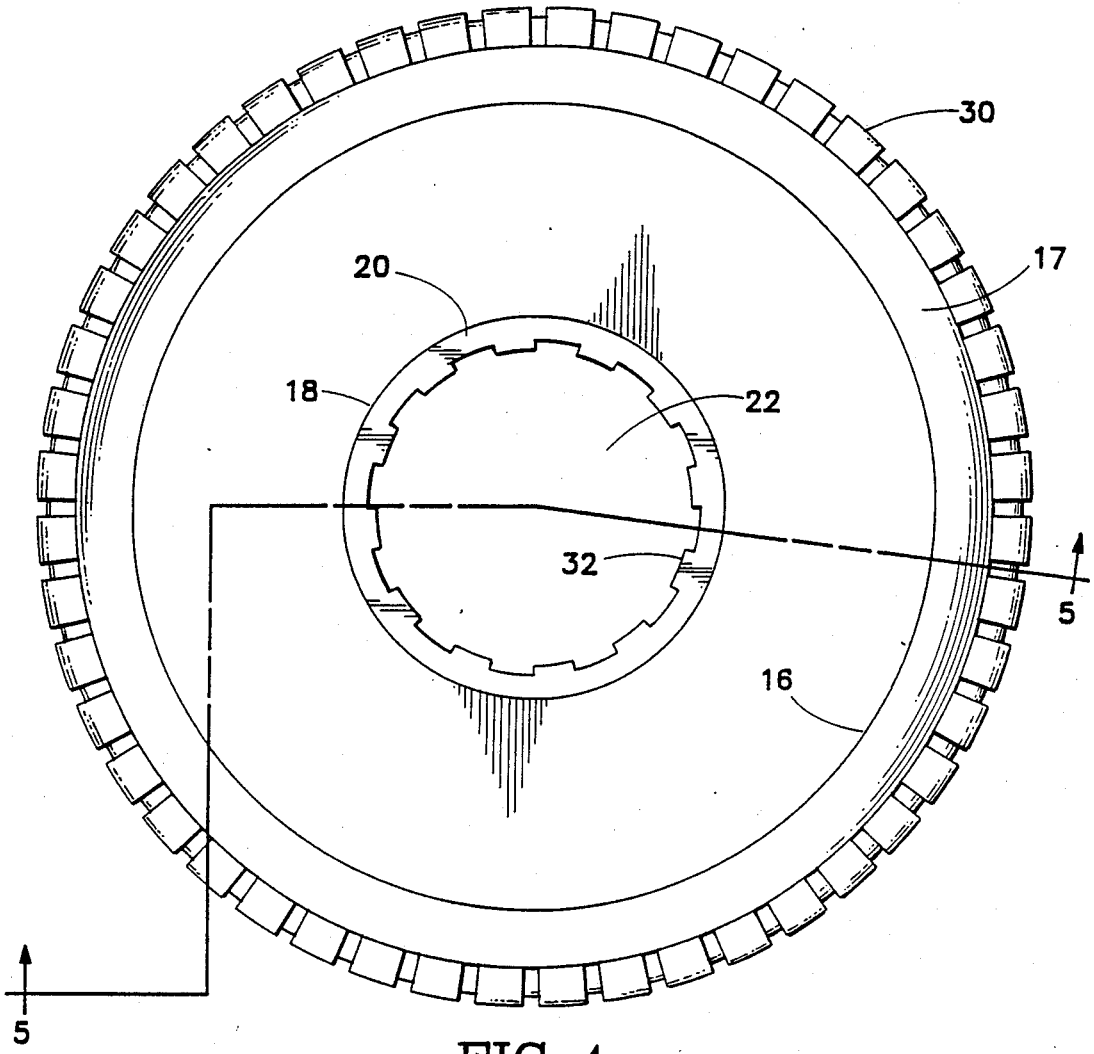
FIG. 4 is a top view of the flying toy incorporating an alternative embodiment of the invention.
Figure 5:
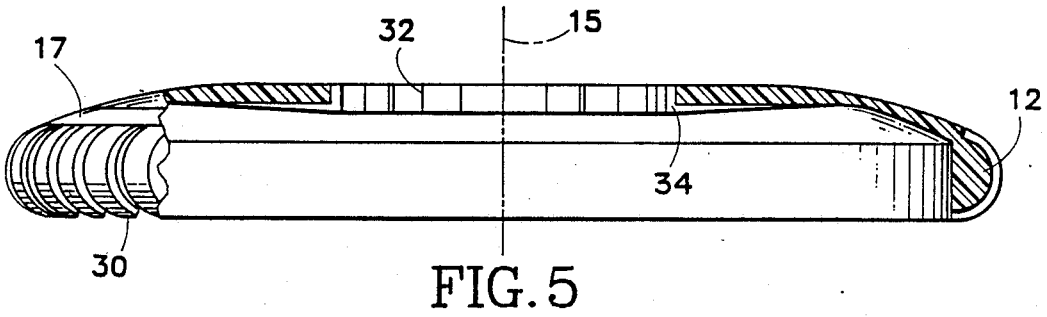
FIG. 5 is a partial section view taken along lines 5—5 of FIG. 4.
Figure 6:
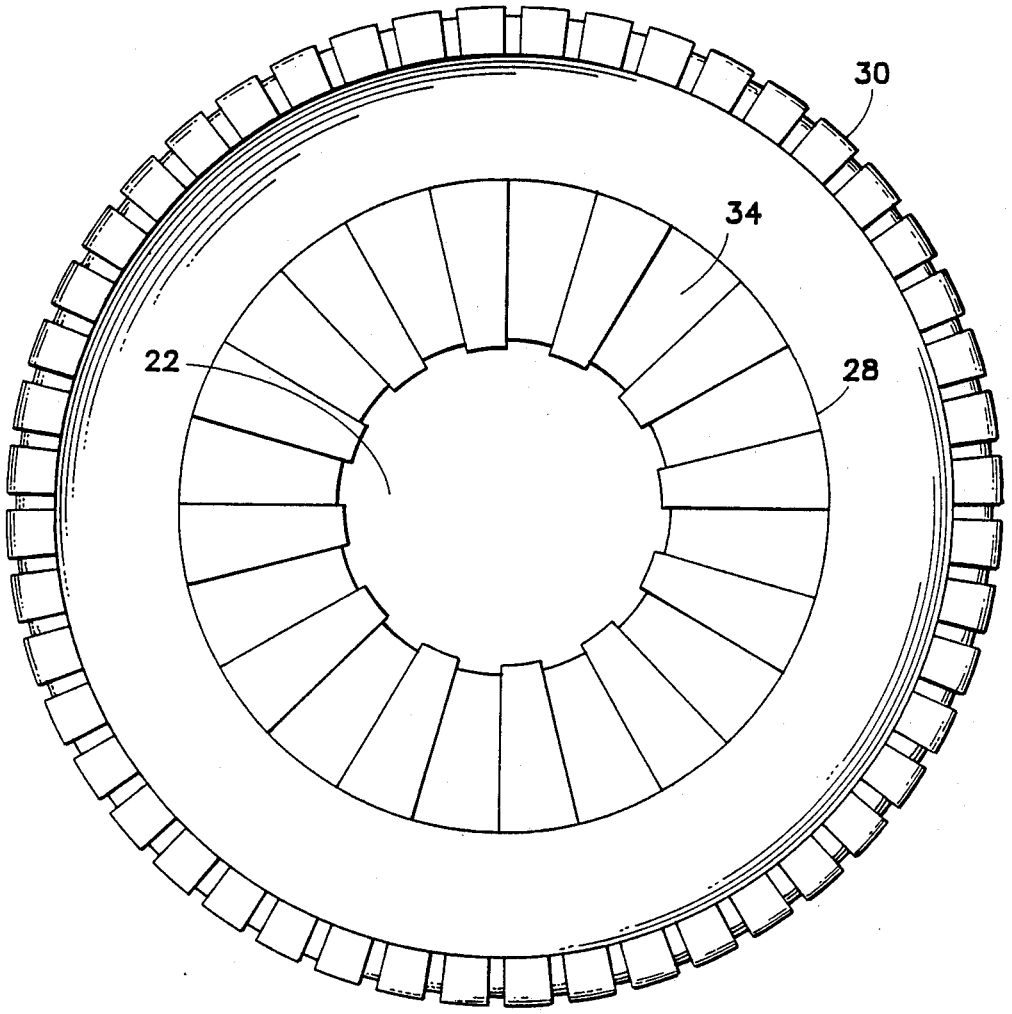
FIG. 6 is a bottom view of the flying toy incorporating the alternative embodiment of the invention shown in FIG. 4 and FIG. 5.

In an alternative embodiment shown in FIGS. 4 through 6, the overall shape of the toy is substantially the same as that shown in FIGS. 1 through 3 except for the design of the three systems of air spoilers. In this alternative embodiment, the edge spoilers 30 are comprised of a plurality of raised or superimposed ridges, the edges of which are evenly-spaced line segments where each line segment is coplanar with the principal rotation axis 15 of the toy. The aperture spoilers 32 are comprised of a plurality of raised or superimposed ridges, the edges of which are evenly-spaced line segments parallel to the principal rotation axis 15 of the toy. The lower spoilers 34 are comprised of a plurality of raised or superimposed ridges, the edges of which are evenly-spaced radially-directed line segments.

Figure 7:
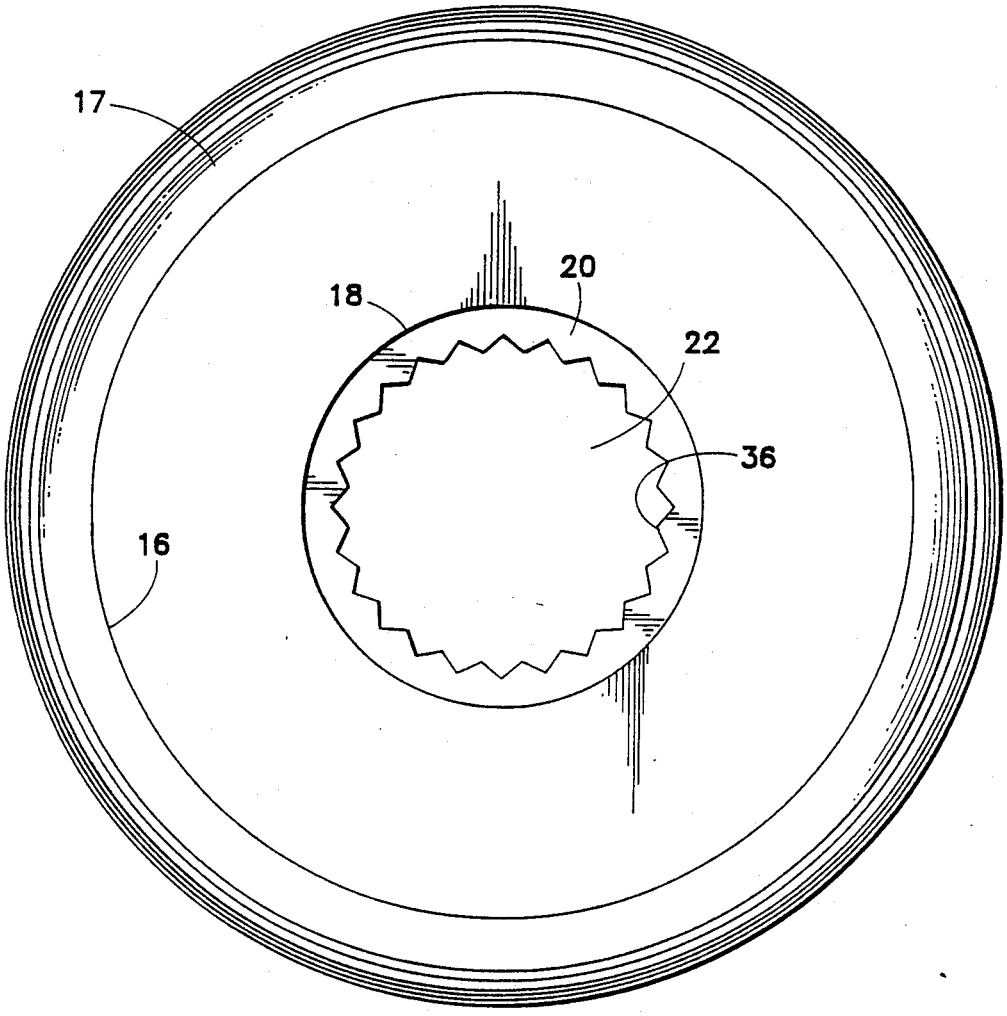
FIG. 7 is a top view of the flying toy incorporating a second alternative embodiment of the invention.

In a second alternative embodiment, shown in FIG. 7, the overall shape of the toy is substantially the same as that shown in FIGS. 1 through 3 except that the aperture spoilers 36 are comprised of a plurality of peaked ridges constructed in a zigzag pattern around the inner surface of the circumscribing lip 20. The edges of these ridges are evenly-spaced line segments parallel to the principal rotation axis 15. The edge spoilers and the lower spoilers contemplated for the disclosure of FIG. 7 can each be of the design shown in the preferred embodiment of FIGS. 1 through 3 or of the design shown in the alternative embodiment of FIGS. 4 through 6, or any combination thereof.

Figure 8:
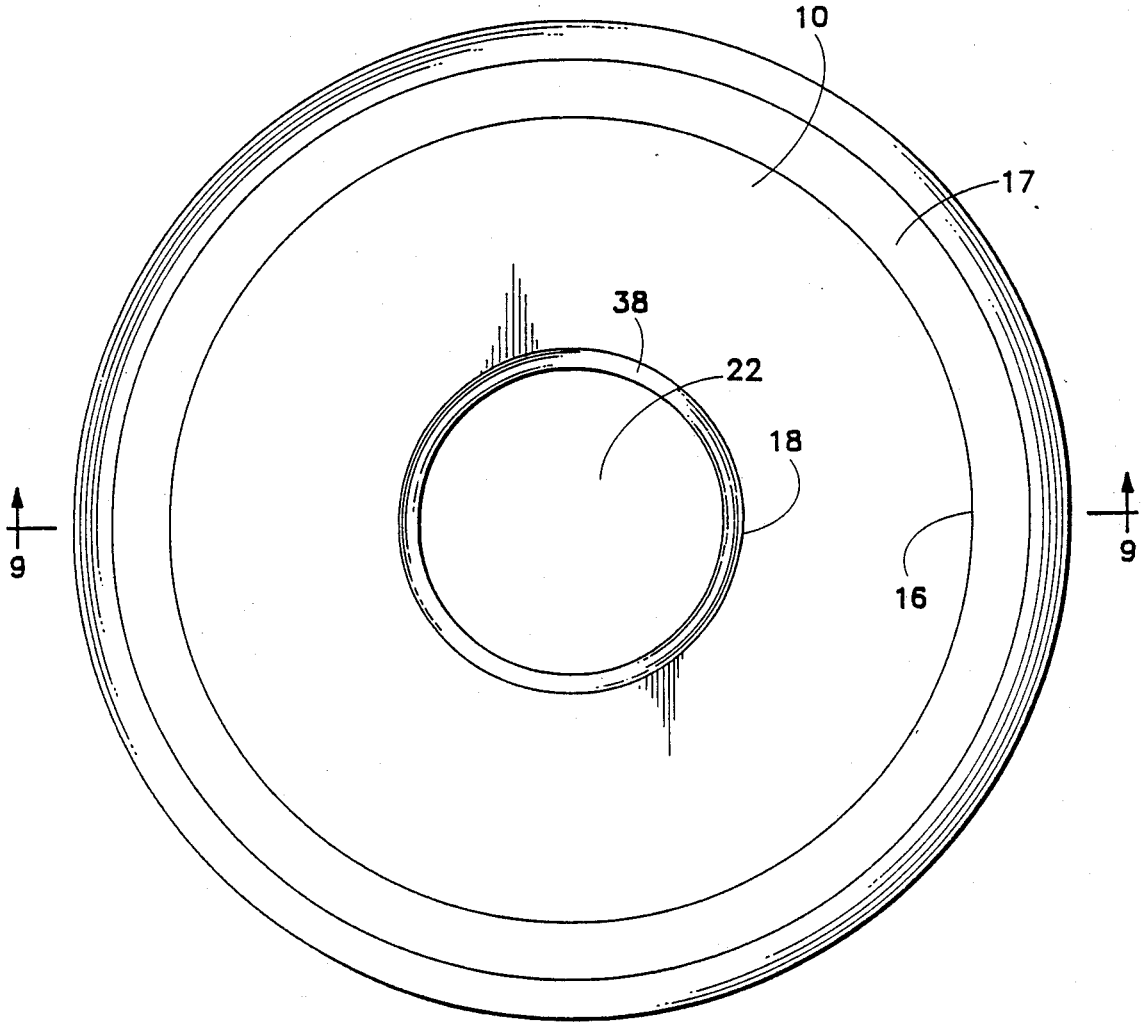
FIG. 8 is a top view of the flying toy incorporating a third alternative embodiment of the invention.
Figure 9:
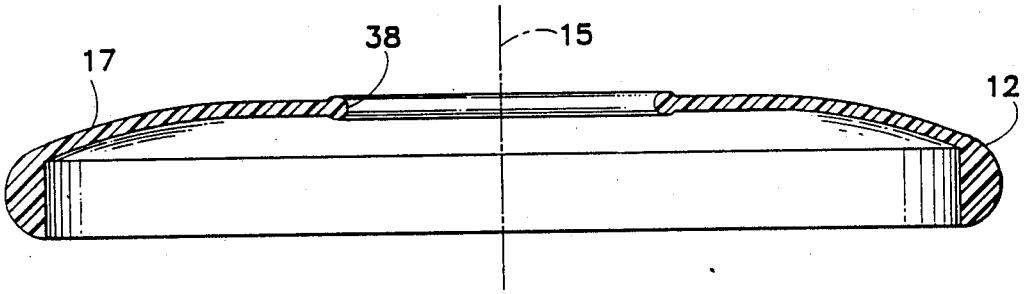
FIG. 9 is a full section view taken along lines 9—9 of FIG. 8.

FIGS. 8 and 9 show a third alternative embodiment. The disclosed toy shown in FIGS. 8 and 9 consists of a substantially planar circular annular section 10 with central aperture 22, a peripheral flange-like rim 12, and a surface of curvature 17 that extends from the outer boundary 16 of the annular section 10 and curves downwardly to a point of juncture with the top edge of the rim 12. No edge spoilers, aperture spoilers, or lower spoilers are contemplated for this third alternative embodiment of the disclosure. This embodiment retains many of the flight characteristics of the previous embodiments, but does not exhibit the higher degree of stability and predictability that the spoiler systems provide. The advantage of this embodiment over previous embodiments is that, being of simpler design, this embodiment is more easily manufactured. As shown in FIGS. 8 and 9, a circumscribing lip 38 in the shape of a bead of circular (or triangular) cross section can be placed along the inner boundary of the annular section for the purpose of providing strength to this boundary. Except for the lip 38, the upper surface of the embodiment shown in FIG. 9 most proximate the aperture is substantially flat and is the highest level, or apex, of the toy.

We have discovered that for each embodiment of the disclosure the stability of air flow patterns past the outer edge of the toy and through the toy's aperture while the toy descends depend substantially on parametric values that interrelate physical characteristics of the toy itself. Approximate values of these parameters that give the disclosed toy optimal hovering and landing characteristics are as follows:

- ratio of area of lower surface (excluding rim) to total weight of toy: 3.3 square centimeters per gram
- ratio of rim weight to total weight: 0.50
- ration of diameter of aperture to diameter of toy: 0.32
- distance between bottom edge of rim and apex of surface: 1.0 inch While we have found these parametric values to be the optimal for shortrange toss games, it is noted that the values can be varied somewhat and still be within an acceptable range. The acceptable ranges are as follows:

- ratio of area of lower surface (excluding rim) to total weight of toy: 3.1 to 3.5 square centimeters per gram
- ratio of rim weight to total weight: 0.40 to 0.60
- ratio of diameter of aperture to diameter of toy: 0.25 to 0.40
- distance between bottom edge of rim and apex of surface: $\frac{3}{4}$ to $1\frac{1}{4}$ inch Using the preferred parametric values we have determined approximate parameters for three sizes of the disclosed toy, each size designed for the hand size and skill level of a particular age group:

| Age Range (in years) | Toy Diameter (in cm) | Aperture Diameter (in cm) | Toy Weight (in gm) | Rim Weight (in gm) |
|---|---|---|---|---|
| 4–6 | 15 | 4.8 | 50 | 25 |
| 7–10 | 19 | 6.1 | 75 | 38 |
| 11 & over | 23 | 7.4 | 100 | 50 |

CONCLUSION AND SCOPE OF THE INVENTION

From the above discussion, the reader will see that the disclosed toy provides a light-weight, inexpensive, multi-use aerodynamic flying device that can be enjoyed by young children as well as by adults.

While our discussion contains many specificities, these should not be construed as limitations on the scope of the invention, but rather as an exemplification of the preferred embodiments thereof. It will be apparent to those skilled in the art that certain changes can be made in certain details without departing from the spirit and principles of the invention. For example, the edge spoilers, the aperture spoilers, and the lower spoilers can can be constructed so as to only partially cover the surface regions on which they're placed. Or, a toy can be constructed that contains only one or two of the three spoiler systems, obtaining part but not all of the advantages afforded by all three systems. Each of these design variations, contemplated as further alternative embodiments of the disclosed toy, decreases the overall stability of the toy as contemplated in its preferred embodiment, but each variation relies in principle on the disclosure herein. Similarly, the various designs of the systems of air spoilers can be used in combination, each combination still relying in principle on the disclosure herein. Accordingly, the scope of this invention should be determined not solely by the discussion and the embodiments illustrated herein, but additionally by the appended claims and their legal equivalents.

We claim:

1. An aerodynamic toy device comprising:

(a) a ring-like part comprising a substantially planar circular annular section of substantially uniform thickness, said annular section having an outer boundary defined by a predetermined first radius, and said annular section having an inner boundary defined by a predetermined second radius;

(b) a lip placed along said inner boundary of said annular section, said lip being thicker than the average thickness of said annular section;

(c) an annular rim circumscribing said annular section, said rim being thicker than said annular section and said rim comprising a top edge, a bottom edge, a substantially cylindrical inner surface, and a curved outer surface, the curvature of said outer surface giving the outer edge of said toy device the shape of an airfoil, and the outermost edge of said rim being defined by a predetermined third radius, said third radius being equal to one-half the maximum width of said toy device, and said third radius being related to said second radius such that the ratio of said second radius to said third radius is in the range 0.25 to 0.40.

(d) a surface of curvature extending from said outer boundary of said annular section and curving downwardly to a point of juncture with said top edge of said rim;

(e) a principal rotation axis that is substantially normal to said annular section;

(f) an overall convex upper surface and an overall concave lower surface of said toy device formed from the combining of said annular section, said surface of curvature, and said rim, wherein parts of said upper surface most proximate said aperture are most substantially normal to said principal rotation axis;

(g) an overall weight distribution such that the ratio of the weight of said rim to the total weight of said toy device is in the range of 0.40 to 0.60.

2. The invention of claim 1, further comprising a plurality of air flow spoilers placed on said outer curved surface of said rim, said spoilers being raised coaxial edges, the edges of said ridges being evenly spaced and in the shape of circles substantially normal to and centered on said principal rotation axis.

3. The invention of claim 1, further comprising a plurality of air flow spoilers placed in an annular region on said concave lower surface of said toy device, said spoilers being raised coaxial ridges, the edges of said ridges being evenly-spaced radially-directed line segments.

4. The invention of claim 1, further comprising a plurality of air flow spoilers placed in an annular region of said concave lower surface of said toy device, said spoilers being raised coaxial ridges, the edges of said ridges being evenly spaced and circular, being centered on said principal rotation axis.

5. The invention of claim 1, further comprising a plurality of air flow spoilers placed along the inner surface of said lip, said air flow spoilers being raised ridges, the edges of said ridges being evenly-spaced line segments parallel to said principal rotation axis.

6. The invention of claim 1, wherein said ratio of said predetermined second radius to said predetermined third radius is 0.32.

7. The invention of claim 1, wherein said ratio of said weight of said rim to said total weight of said toy device is 0.50.

8. An aerodynamic toy device comprising:

(a) a ring-like part comprising a substantially planar circular annular section of substantially uniform thickness, the outer boundary of said annular section being defined by a predetermined first radius, and the inner boundary of said annular section being defined by a predetermined second radius;

(b) a lip placed along said inner boundary of said annular section, said lip defining the periphery of a single aperture centrally located in said annular section, and said lip comprising:

(i) a top edge, an inner surface facing said aperture, and a bottom edge, and (ii) aperture spoiler means for spoiling the laminar flow of air past said inner surface of said lip, said aperture spoiler means being placed along said inner surface of said lip;

(c) an annular rim circumscribing said annular section, said rim being thicker than said annular section and said rim comprising (i) a top edge, a bottom edge, a substantially cylindrical inner surface, and a curved outer surface, the curvature of said outer surface giving the outer edge of said toy device the shape of an airfoil, and the outermost edge of said rim being defined by a predetermined third radius, said third radius being equal to one-half the maximum width of said toy device, and (ii) edge spoiler means for spoiling the laminar flow of air past said outer curved surface of said rim, said edge spoiler means being placed along said outer curved surface of said rim from said bottom edge of said rim to said top edge of said rim;

(d) a surface of curvature extending from said outer boundary of said annular section and curving downwardly to a point of juncture with said top edge of said rim;

(e) an overall convex upper surface and an overall concave lower surface of said toy device formed from the combining of said annular section, said surface of curvature, and said rim, said concave lower surface comprising in part:

(i) an annular region whose inner boundary is defined by said bottom edge of said lip and whose outer boundary is determined by a predetermined fourth radius, and (ii) lower spoiler means for spoiling the laminar flow of radially directed air flowing across said annular region of said concave lower surface, said lower spoiler means being placed in the area between said bottom edge of said lip and said outer boundary of said annular region of said lower surface;

(f) a principal rotation axis which is substantially normal to said annular section.

9. The invention of claim 8, wherein said second radius is related to said third radius such that the ratio of said second radius to said third radius is in the range of 0.25 to 0.40.

10. The invention of claim 9, wherein said ratio of said second radius to said third radius is 0.32.

11. The invention of claim 8, wherein the ratio of the weight of said rim to the total weight of said toy device is in the range of 0.40 to 0.60.

12. The invention of claim 11, wherein said ratio of said weight of said rim to said total weight of said toy device is 0.50.

13. The invention of claim 8, wherein said edge spoiler means comprise a plurality of raised coaxial ridges, the edges of said ridges being evenly spaced and in the shape of circles substantially normal to and centered on said principal rotation axis.

14. The invention of claim 8, wherein said edge spoiler means comprise a plurality of parallel raised ridges, the edges of said ridges being evenly-spaced line segments, said line segments being coplanar with said principal rotation axis.

15. The invention of claim 8, wherein said lower spoiler means comprise a plurality of raised coaxial ridges, the edges of said ridges being evenly spaced and in the shape of circles substantially normal to and centered on said principal rotation axis.

16. The invention of claim 8, wherein said aperture spoiler means comprise a plurality of raised coaxial ridges, the edges of said ridges being evenly-spaced and in the shape of circles substantially normal to and centered on said principal rotation axis.

17. The invention of claim 8, wherein said aperture spoiler means comprise a plurality of raised ridges, the edges of which are evenly-spaced line segments parallel to said principle rotation axis.

18. The invention of claim 8, wherein said aperture spoiler means comprise a plurality of peaked ridges formed as evenly-spaced angular protrusions arranged to produce a zigzag pattern around said inner surface of said lip, the edges of said ridges being evenly-spaced line segments parallel to said principal rotation axis.

* * * * *